US011274390B2

(12) United States Patent
Kim et al.

(10) Patent No.: US 11,274,390 B2
(45) Date of Patent: Mar. 15, 2022

(54) CLOTHES TREATING DEVICE

(71) Applicant: LG ELECTRONICS INC., Seoul (KR)

(72) Inventors: Jaehyung Kim, Seoul (KR); Hyungha Kang, Seoul (KR); Semin Jang, Seoul (KR); Joosik Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 119 days.

(21) Appl. No.: 16/469,787

(22) PCT Filed: Dec. 12, 2017

(86) PCT No.: PCT/KR2017/014527
§ 371 (c)(1),
(2) Date: Jun. 14, 2019

(87) PCT Pub. No.: WO2018/110935
PCT Pub. Date: Jun. 21, 2018

(65) Prior Publication Data

US 2020/0080245 A1 Mar. 12, 2020

(30) Foreign Application Priority Data

Dec. 16, 2016 (KR) ..... 10-2016-0172479

(51) Int. Cl.
*D06F 39/08* (2006.01)
*D06F 35/00* (2006.01)
(Continued)

(52) U.S. Cl.
CPC ..... *D06F 39/085* (2013.01); *D06F 35/00* (2013.01); *D06F 58/10* (2013.01); *D06F 58/20* (2013.01); *D06F 58/203* (2013.01)

(58) Field of Classification Search
CPC ..... A47L 15/00–15/508
See application file for complete search history.

(56) References Cited

U.S. PATENT DOCUMENTS 1,170,653 A 2/1916 Marette
2,643,614 A * 6/1953 Rosenkrans ..... H02K 7/108 417/319

(Continued)

FOREIGN PATENT DOCUMENTS

CN 202107909 U 1/2012
CN 204097757 U 1/2015

(Continued)

OTHER PUBLICATIONS

Australian Office Action dated Sep. 11, 2020 on Application No. 2017374402.

(Continued)

*Primary Examiner* — Michael E Barr
*Assistant Examiner* — Omair Chaudhri
(74) *Attorney, Agent, or Firm* — Finnegan, Henderson, Farabow, Garrett & Dunner, LLP

(57) ABSTRACT

A clothes treating device includes a clothes accommodation part for accommodating clothes or laundry, a water supply pipe for supplying water into the clothes treating device, and a drain pipe for discharging water to the outside of the clothes treating device. A pump assembly generates a flow of water inside the water supply pipe and the drain pipe by using the rotation of a motor. The flow of water is generated only in one of the water supply pipe and the drain pipe depending on the rotating direction of the motor.

15 Claims, 14 Drawing Sheets

(51) Int. Cl.
*D06F 58/10* (2006.01)
*D06F 58/20* (2006.01)

(56) References Cited

U.S. PATENT DOCUMENTS

| | | | | |
|---|---|---|---|---|
| 2009/0320213 | A1* | 12/2009 | Lee | A47L 15/4234 8/159 |
| 2011/0154866 | A1* | 6/2011 | Lee | D06F 39/008 68/5 C |
| 2016/0251794 | A1* | 9/2016 | Kim | D06F 37/40 8/137 |

FOREIGN PATENT DOCUMENTS

| | | | | |
|---|---|---|---|---|
| DE | 102015209529 | | 11/2016 | |
| DE | 102015209529 | A1 * | 11/2016 | A47L 15/4225 |
| EP | 0465787 | | 1/1992 | |
| EP | 2055827 | | 5/2009 | |
| JP | 03222894 | A * | 10/1991 | |
| JP | H03222894 | | 10/1991 | |
| JP | 10-300279 | A | 11/1998 | |
| JP | 11-201078 | | 7/1999 | |
| KR | 20-1993-0019831 | | 2/1992 | |
| KR | 10-0569259 | | 4/2006 | |
| KR | 10-2007-0059433 | | 6/2007 | |
| KR | 10-1025495 | | 4/2011 | |
| KR | 10-2011-0099914 | | 9/2011 | |
| KR | 10-2011-0127419 | | 11/2011 | |
| WO | WO 2007/058477 | | 5/2007 | |
| WO | WO 2010/145869 | | 12/2010 | |

OTHER PUBLICATIONS

Written Opinion of the ISA and International Search Report dated Mar. 19, 2018.
Chinese Office Action dated Nov. 20, 2020 on Application No. 201780083587.9.
European Search Report dated Jun. 2, 2020.

* cited by examiner

CLOTHES TREATING DEVICE

CROSS-REFERENCE TO RELATED APPLICATIONS

This application is a U.S. National Phase entry under 35 U.S.C. § 371 from PCT International Application No. PCT/KR2017/014527, filed Dec. 12, 2017, which claims the benefit of priority of Korean Patent Application No. 10-2016-0172479, filed Dec. 16, 2016, all of which are incorporated herein by reference in their entireties.

FIELD

The present invention relates to a clothes treating apparatus.

BACKGROUND

In general, a clothes treating apparatus is a home appliance configured to perform diverse treating processes that are related to clothes (e.g., washing, drying, deodorizing, wrinkle-removing and the like). The clothes treating apparatus may include a washing machine for washing clothes, a dryer for drying wet clothes and a refresher for deodorizing clothes or removing wrinkles from clothes.

A conventional structure of such a clothes treating apparatus is disclosed in Korean Patent No. 10-2008-0030333.

A clothes treating apparatus may provide one device that performs washing, drying, deodorizing and wrinkles-removing functions. A water supply system and a water discharge system provided in the clothes treating apparatus may require multiple pumps configured to generate flow. However, when many functions are combined in one device, the overall volume of the clothes treating apparatus may increase disadvantageously.

DETAILED DESCRIPTION

Technical Problem

In one aspect of the present disclosure, a clothes treating apparatus may perform an independent cycle for each of a plurality of passages by installing one pump assembly in the passages.

Another aspect of the present disclosure is to provide a clothes treating apparatus that may generate water flow through a passage in a water supply pipe or a water discharge pipe according to a rotational direction of a motor.

A further aspect of the present disclosure is to provide a clothes treating apparatus that may reduce an installation space.

Yet another aspect of the present disclosure is to provide a clothes treating apparatus that may save the cost of materials.

A still further aspect of the present disclosure is to provide a clothes treating apparatus that may consume less energy during operation.

Technical Solution

A clothes treating apparatus according to various embodiments of this disclosure may include a clothes-accommodation unit configured to accommodate clothes or laundry. The clothes treating apparatus may include a water supply pipe that supplies water to the inside of the clothes treating apparatus, and a water discharge pipe that discharges the water to the outside from the clothes treating apparatus. A pump assembly may be configured to generate flow of the water inside the water supply pipe and the water discharge pipe, using rotation of a motor, wherein the flow of the water is generated only in the water supply pipe or only in the water discharge pipe depending on a rotational direction of the motor. The clothes treating apparatus which may perform an independent cycle for each of passages by installing one pump assembly in the passages. In addition, the clothes treating apparatus may reduce an installation space and save the cost of materials.

The pump assembly may include a wheel that is configured to be rotated by the motor, and a pair of clutches provided on both sides of the wheel, respectively. Each of the clutches may have a rotational center that is located coaxially with a rotational center of the wheel. The pair of the clutches may be independently rotatable with respect to the wheel. A pair of shafts may be fixed to rotational centers of the clutches, respectively. An impeller may be connected with each of the shafts and rotatable in conjunction with the rotation of the clutches. A connecting part may be rotatably mounted to the wheel and configured to transmit a rotational force of the wheel to one of the clutches based on the rotational direction of the motor. The clothes treating apparatus may generate water flow in the water supply pipe or the water discharge pipe depending on the rotational direction of the motor.

The pair of the clutches may include a first clutch provided on one side of the wheel, and a second clutch provided on the other side of the wheel. The connecting part may include a first connecting arm and a second connecting arm that are spaced a preset distance apart from the rotational center of the wheel and symmetrically arranged with respect to the rotational center. The clothes treating apparatus may generate water flow in the water supply pipe or the water discharge pipe according to the rotational direction of the motor.

Each of the connecting arms may include a connecting bar rotatably coupled to the wheel and provided in parallel with one of the pair of shafts. A first hand may be provided on one end of the connecting bar, and a second hand may be provided on the other end of the connecting bar. The first hand may rotate the first clutch by contacting with the first clutch, and the second hand may rotate the second clutch by contacting with the second clutch. The clothes treating apparatus may perform an independent cycle for each of respective passages that supply and discharge fluid to and from the clothes accommodation unit by including one pump assembly in the respective passages.

When the motor is rotated in one direction, the first hand may contact with the first clutch and the second hand may not contact with the second clutch. When the motor is rotated in the reverse direction, the first hand may not contact with the first clutch and the second hand may contact with the second clutch.

The first clutch may include a first projection projected towards the wheel and configured to be contacted by the first hand, and the second clutch may include a second projection projected towards the wheel and configured to be contacted by the second hand.

Two first projections may be symmetrically provided with respect to the rotational center of the first clutch, and two second projections may be symmetrically provided with respect to the rotational center of the second clutch. When the rotational direction of the motor is changed, a change in the direction of fluid flow between flow through the passage in the water supply pipe and flow through the passage in the water discharge pipe may be performed.

Each of the first and second projections may comprise a contact surface that is configured to contact the first hand or the second hand, and a collision surface provided to collide with the first hand or the second hand. When the rotational direction of the motor is changed, the change in the direction of fluid flow from flow through the water supply pipe to flow through the water discharge pipe may be performed.

The contact surface on each of the projections of the first and second clutches may have a larger area than the collision surface on each of the projections. The smaller area of each of the collision surfaces as compared to the area of each of the contact surfaces on the projections results in a sharper impact force being exerted upon collision of a respective one of the first and second hands against the collision surfaces. Reference in this application to "collision" surfaces of the projections on the first and second clutches, and the "collision surfaces" of the projections "colliding" with the first and second hands of the connecting arms is differentiated from "contact surfaces" and "contacting" as a result of the sharper impact force caused by a smaller surface area at the point of collision between a projection and a hand of a connecting arm as compared to the force generated by a larger surface area at the point of contact between a projection and a hand.

The first hand and the second hand on each of the connecting arms may be perpendicular with each other. The structure may be the optimal structure for changing the direction of rotation of the first and second clutches, with the resulting efficient change of fluid flow through the water supply pipe or through the water discharge pipe.

Each of the first and second hands may comprise a planar surface provided on a predetermined area of each hand and a curved surface provided on another area of each hand.

When the wheel is rotated in one direction, the planar surfaces of the first hands may contact with the contact surfaces of the first projections, respectively, and the second hands may not contact with the second projections.

When the wheel is rotated in the reverse direction, the planar surfaces of the second hands may contact with the contact surfaces of the second projections and the first hands may not contact with the first projections.

When the wheel is rotated in the reverse direction after being rotated in one direction for a preset time period, the curved surfaces of the first hands may collide with the collision surfaces of the first projections and the connecting bars may then be rotated.

The rotation of the connecting bars may facilitate contact between the planar surfaces of the second hands and the contact surfaces of the second projections, and the first hands may not contact the first projections.

The clothes treating apparatus may further include a steam supply device configured to supply steam to the clothes-accommodation unit, and a heat pump configured to generate hot air.

The impeller may include a first impeller in fluid communication with the water supply pipe, and a second impeller in fluid communication with the water discharge pipe. The first impeller and the second impeller may not be rotated at the same time.

A pump assembly is configured to generate flow of water inside a water supply pipe and a water discharge pipe that are provided in a clothes treating apparatus, using rotation of a motor. The pump assembly may include: a first passage pipe connected with the water supply pipe; and a second passage pipe connected with the water discharge pipe, wherein flow of water is generated only in the first passage pipe or only in the second passage pipe, respectively, depending on a rotational direction of the motor. The clothes treating apparatus may perform an independent cycle for each of the passages by installing one pump assembly in the passages. In addition, the clothes treating apparatus may reduce an installation space and save the cost of materials.

The pump assembly may also include a wheel that is rotatable by the motor; a pair of clutches provided on both sides of the wheel, respectively, and having rotational centers that are coaxial with the rotational center of the wheel, the pair of the clutches being independently rotatable with respect to the wheel; a pair of shafts fixed to rotational centers of the clutches, respectively; an impeller connected with each of the shafts and rotatable according to the rotation of the clutches; and a connecting part provided on the wheel and configured to transmit a rotational force of the wheel to one of the clutches based on the rotational direction of the motor.

The pair of the clutches may comprise a first clutch provided on one side of the wheel, and a second clutch provided on the other side of the wheel. The connecting arm may include a first connecting arm and a second connecting arm that are spaced a preset distance apart from the rotational center of the wheel and symmetrically arranged with respect to the rotational center.

Advantageous Effects

As is apparent from the above description, the present disclosure has the effect of providing a clothes treating apparatus that may perform an independent cycle for each of two passages by installing one pump assembly in the two passages.

In addition, the present disclosure has the effect of providing a clothes treating apparatus that may generate flow in a passage of a water supply pipe or a water discharge pipe depending on a rotational direction of a motor.

In addition, the present disclosure has the effect of providing a clothes treating apparatus that may reduce an installation space.

In addition, the present disclosure has the effect of providing a clothes treating apparatus that may save the cost of materials.

In addition, the present disclosure has the effect of providing a clothes treating apparatus that may consume less energy during operation.

BRIEF DESCRIPTION OF THE DRAWINGS

FIG. 13 is rotated in clockwise and counterclockwise directions after a preset time period following the positions shown in FIG. 13.

DESCRIPTION OF SPECIFIC EMBODIMENTS

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

Figure 1:
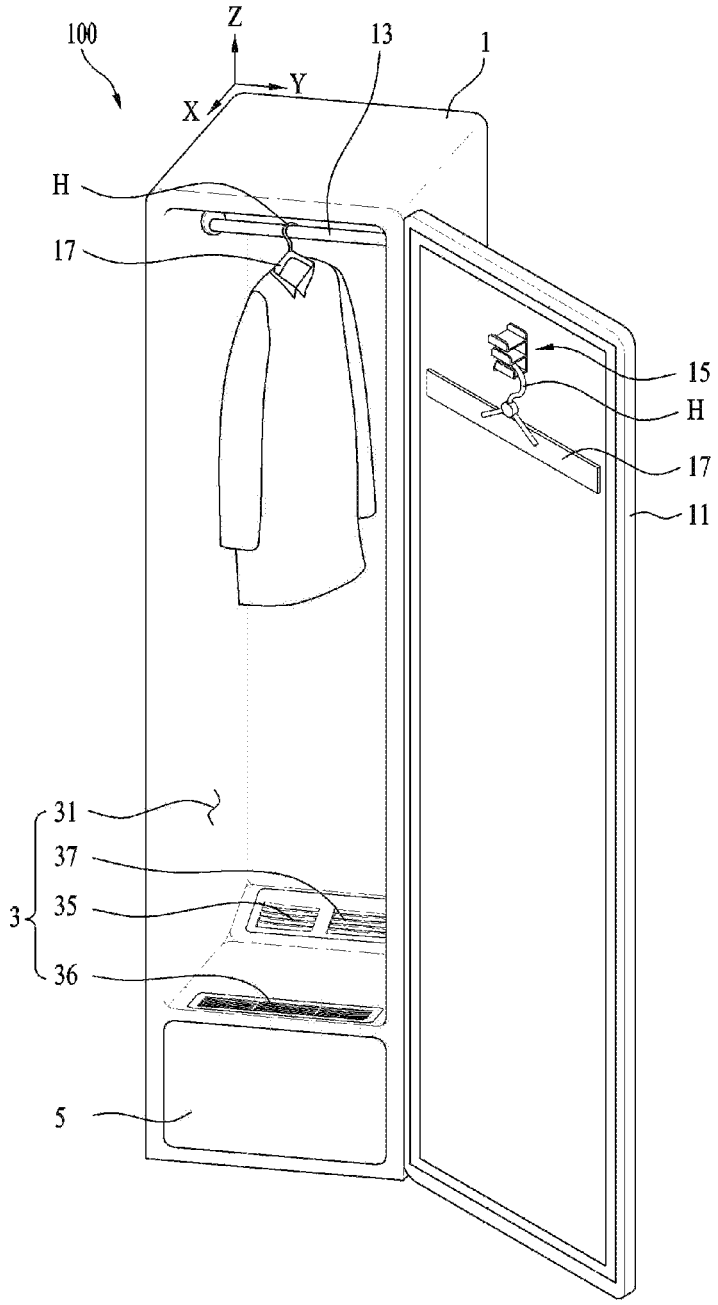
FIG. 1 is a perspective view of a clothes treating apparatus according to one embodiment of the present disclosure.

As shown in FIG. 1, the clothes treating apparatus 100 in accordance with one embodiment of the present disclosure includes a cabinet 1 defining an exterior design; a clothes-accommodation unit 3 provided in the cabinet 1 and providing a predetermined space for holding clothes or laundry; a mechanical chamber 5 configured to supply at least one of the air or moisture to the clothes-accommodation unit 3; and a pump assembly 7 configured to supply or discharge water.

A predetermined space (hereinafter, an accommodation space 31) may be defined in the clothes-accommodation unit 3 to accommodate clothes or laundry and the accommodation space 31 may be open and closed by a door 11 provided in the cabinet 1.

A laundry support unit may be further provided in the cabinet 1 to support the clothes or laundry. The laundry support unit may include a first laundry support part 13 provided in the accommodation space 31, and a second laundry support part 15 provided in the door 11.

The first laundry support part 13 may be provided in a bar shape provided along either a depth direction of the accommodation space 31 (a direction of X-axis) or a width direction of the accommodation space (a direction of Y-axis or a width direction of the door). FIG. 1 illustrates one example of the first laundry part 13 that is provided along the width direction of the accommodation space 31.

In this instance, clothes may be supported by a hook (H) of a hanger 17 provided on the first laundry support part 13 or they may be supported on the first laundry support part 13 without the hanger 17. In any case, clothes may be kept spread and unfolded in the accommodation space 31.

The second laundry support part 15 may be provided on the door 11 to allow the clothes to be located in a state of being spread in the accommodation space 31. In other words, the second laundry support part 15 may be fixed to the door 11 as shown in FIG. 1. A hook (H) provided in the hanger 17 may be supported to the second laundry support part 15.

The mechanical chamber 5 may be provided in a lower area of the accommodation space 31 and partitioned off from the accommodation space 31 by a partition wall. In this instance, a passage is formed to supply the dry air and steam generated in the mechanical chamber 5 to the accommodation space 31.

The dry air generated in the mechanical chamber 5 may be discharged into the accommodation space 31 via an air outlet hole 35, and the dry air discharged into the accommodation space 31 may contact the clothes and then be drawn into the mechanical chamber 5 via an air inlet unit 36.

The air outlet hole 35 and the air inlet unit 36 may be provided in the partition wall for partitioning off the space inside the cabinet 1 into the accommodation space 31 and the mechanical chamber 5, or alternatively, in a lateral or upper surface of the accommodation space 31 or the door 11. In FIG. 1, the air outlet hole 35 and the air inlet unit 36 may be provided in the partition wall forming a bottom surface of the accommodation space 31, but the air outlet hole 35 and/or the air inlet unit 36 may be provided in other locations.

In one embodiment, the air inlet unit 36 may be provided in a front area of the bottom surface of the accommodation space 31, adjacent to the door 11. When the air inlet unit 36 is provided adjacent to the door 11, it may serve to form an air curtain. When the door 11 is opened and closed, such an air curtain may prevent external air from affecting the internal space inside cabinet 1. The air outlet hole 35 may be provided as far from the air inlet unit 36 as possible such that the discharged air can be supplied uniformly throughout the accommodation space 31.

A steam outlet hole 37 may be further provided in the lower area of the accommodation space 31. The steam generated in a steam generator (52, see FIG. 2) provided in the mechanical chamber 5 may be supplied to the clothes in the accommodation space 31 via the steam outlet hole 37.

The steam outlet hole 37 may be provided in any area in the accommodation space 31. For example, the steam outlet hole 37 may be provided in a lateral surface of the accommodation space 31 or in both of the lateral and bottom surfaces.

Figure 2:
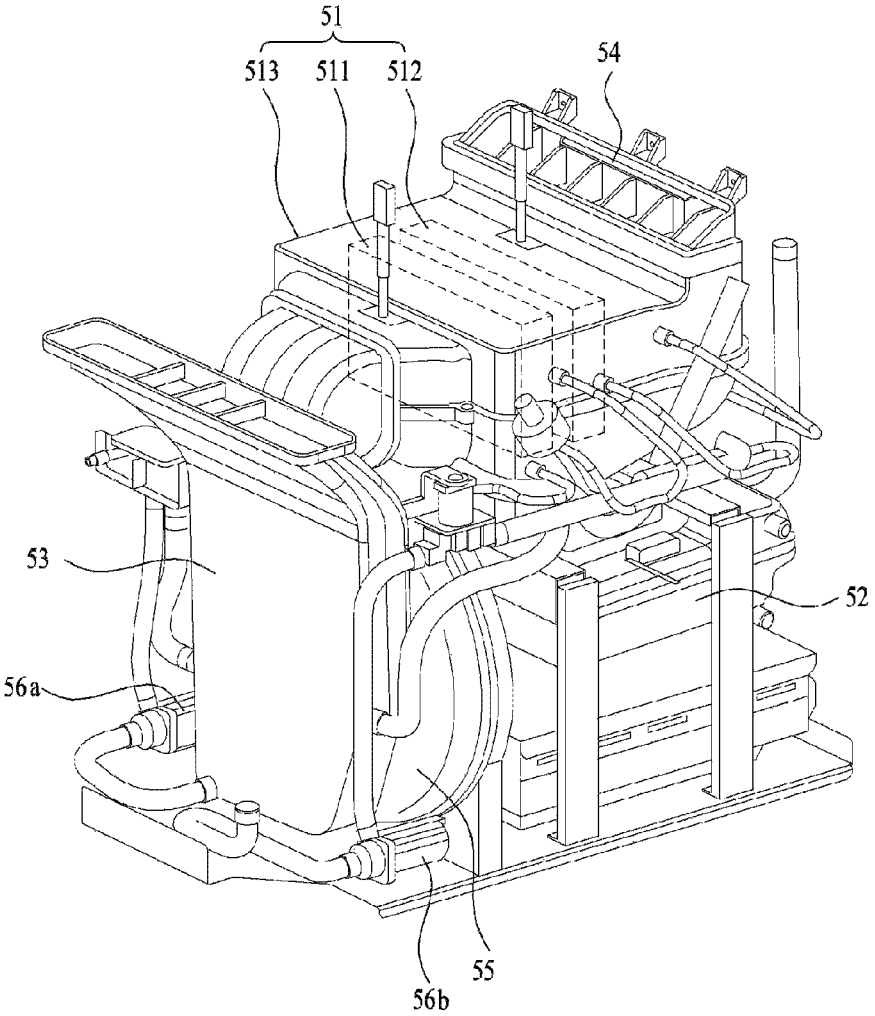
FIG. 2 illustrates a conventional structure of a mechanical chamber provided in the clothes treating apparatus.

FIG. 2 illustrates devices that may be provided in the mechanical chamber 5. The structure of the mechanical chamber may be similar to the structure of a conventional mechanical chamber 5 including a pump assembly 56 configured with a water supply pump **56*a* and a water discharge pump 56*b***.

The mechanical chamber 5 may house a heat pump 51 configured to generate dry air by lowering the humidity and temperature of the air, a steam generator 52 configured to generate steam that will be supplied to the accommodation space 31, a first duct 53 provided in the lower area of the accommodation space 31 in fluid communication with the air inlet unit 36, and a second duct 54 provided in the lower area of the accommodation space 31 and in fluid communication with the air outlet hole 35. The first duct 53 and the second duct 54 may be in fluid communication with each other. The flow of the air may be facilitated by actuation of a fan 55 provided in the mechanical chamber 5.

The internal air of the accommodation space 31 may be drawn into the first duct 53 by the fan 55 via the air inlet unit 36 and then drawn into the second duct 54 from the first duct 53 to pass through the heat pump 51. After passing through the heat pump 51, the air may be discharged into the accommodation space 31 via the air outlet hole 35.

The heat pump 51 may be provided in a heat pump body 513 located in the second duct 54. An evaporator 511 and a condenser 512 may be sequentially installed in the heat pump body 513.

The evaporator 511 is a device through which a low-temperature liquid refrigerant passes and lowers the temperature of latent air passing through the heat pump 51 by receiving heat from the latent air. The condenser 512 is a device through which a high-temperature gas refrigerant passes and raises the temperature of the latent air passing through the heat pump by exchanging heat with the latent air.

The air drawn into the heat pump body 513 may sequentially pass through the evaporator 511 and the condenser 512. The internal air of the accommodation space 31 may have a high humidity or a relatively low temperature because of the presence of clothes in the accommodation space 31. The temperature and humidity of the air may be lowered while passing through the evaporator 511. After that, the temperature of the air may be increased while passing through the condenser 512. Consequently, the heat pump 51 may generate dry-and-high-temperature air.

The pump assembly 56 may be provided in the mechanical chamber 5. The pump assembly 56 may include the water supply pump 56*a* configured to supply moisture to the inside of the clothes treating apparatus 100, and the water discharge pump 56*b* configured to discharge water from the inside of the clothes treating apparatus 100.

Figure 3:
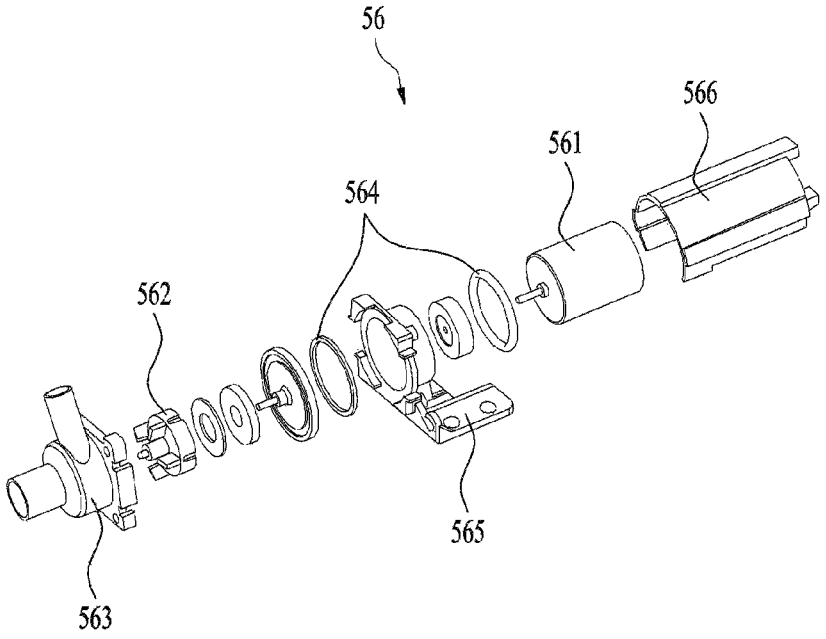
FIG. 3 is a diagram illustrating a conventional structure of a pump assembly provided in the mechanical chamber.

Specific, exemplary structures of the pumps are shown in FIG. 3. Each of the pumps 56*a* and 56*b* may include an impeller 562 configured to generate flow, a motor 561 configured to rotate the impeller 562, and a flow path pipe 563 in which the impeller 562 is arranged. The motor 561 may have a motor bracket 565 provided to mount the motor, and a ring 564 provided to absorb a shock between the motor 561 and the motor bracket 565. To protect the motor 561 mounted in the motor bracket 564, a motor case 566 may be provided in an outer area of the motor. When the motor 561 rotates, the impeller 562 may be rotated and the rotation of the impeller 562 may facilitate the water supply and discharge. Rotation of the impeller 562 generates the water flow. The motor may rotate in a first direction or in a second, opposite direction.

The clothes treating apparatus 100 in accordance with one embodiment of this disclosure may perform washing as well as drying, deodorizing and wrinkles-removing. A clothes treating apparatus that performs washing may include a tub provided to hold laundry, a drum rotatably mounted in the tub, and a drive unit configured to rotate the drum.

Figure 4:
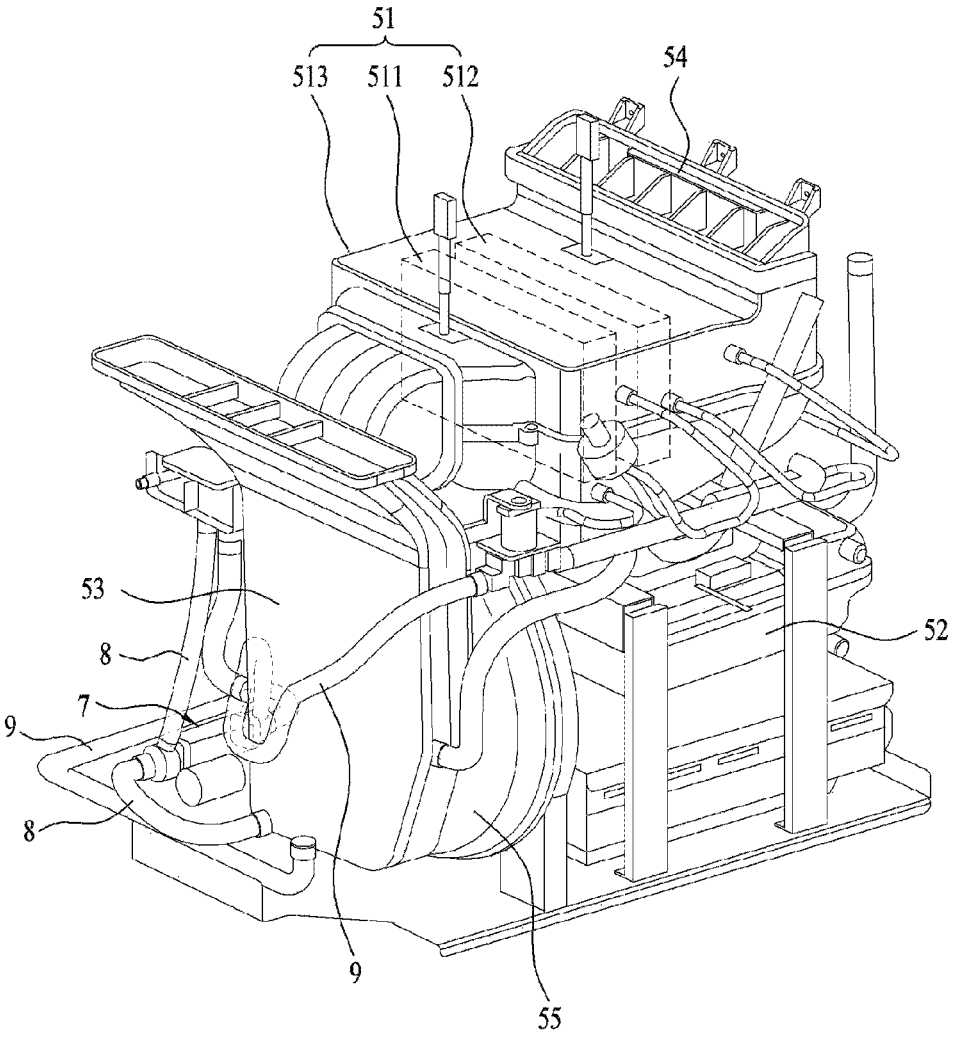
FIG. 4 is a diagram illustrating a structure of a mechanical chamber provided in the clothes treating apparatus according to one embodiment of the present disclosure.

Features of the present disclosure may be included with any type of the clothes treating apparatus having the water supply and discharge capabilities. FIG. 4 illustrates the pump assembly 7 provided in the mechanical chamber 5 in accordance with one embodiment of the present disclosure. However, the embodiment shown in FIG. 4 is just one exemplary embodiment, and the pump assembly 7 may be separated from the mechanical chamber 5 and provided as an independent part located in a different area. As described above, the pump assembly 7 may be applied to a clothes treating apparatus requiring a water supply and discharge system.

FIG. 4 illustrates that the pump assembly 7 in accordance with an embodiment of this disclosure is provided in the mechanical chamber 5. Different from the embodiment shown in FIG. 2, FIG. 4 shows only one pump. In other words, a pump assembly 7 shown in FIG. 4 may realize both the water supply and the water discharge with a single pump. The pump assembly 7 may have one end of the single pump connected with a water supply pipe 8 and the other end of the pump connected with a water discharge pipe 9.

The pump assembly 7 may include a motor (72, see FIGS. 5 through 8). When the motor is rotated in one direction, the pump assembly 7 may generate flow in the water supply pipe 8. The pump assembly 7 may generate flow in the water discharge pipe 9 when the motor is rotated in the reverse direction. Fluid flow is generated in each of the water supply pipe 8 and the water discharge pipe 9 only when the motor is rotated, regardless of the rotational direction of the motor. The pump assembly 7 in accordance with an embodiment of the present disclosure may cycle between providing independent fluid flow in the water supply pipe 8 and in the water discharge pipe 9 based on the direction of rotation of the motor 72.

The specific structure of the pump assembly 7 will be described, referring to FIGS. 5 through 8. FIGS. 5 through 8 illustrate only the pump assembly 7 separately and include a front view, an exploded view and a top view.

Figure 5:
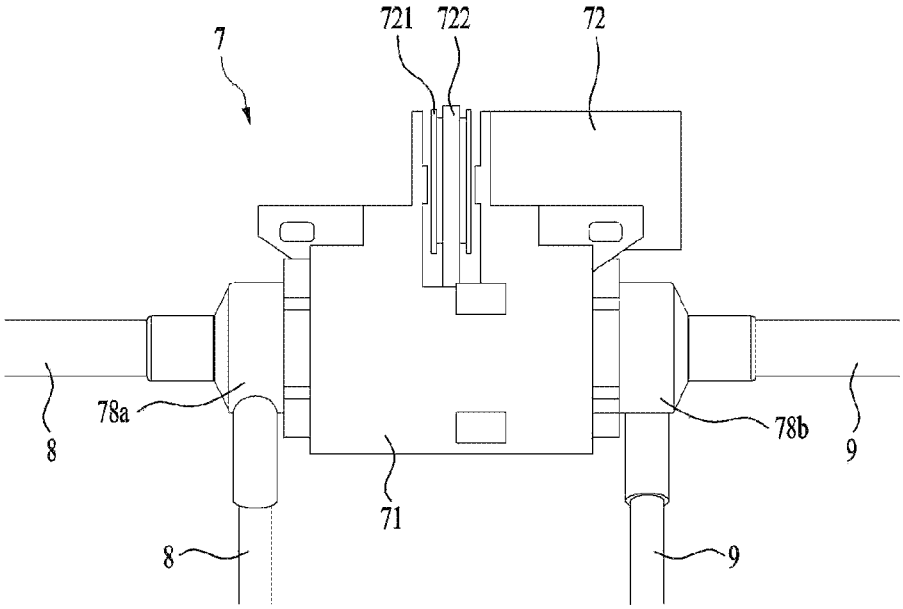
FIG. 5 is a diagram illustrating an exterior design of a pump assembly according to one embodiment.

FIG. 5 illustrates the exterior appearance of the pump assembly 7. Referring to FIG. 5, the pump assembly 7 may include a pump housing 71, a motor 72, a first passage pipe 78*a* connected with the water supply pipe 8 and having a first impeller (77*a*, see FIGS. 6 and 7) arranged therein, and a second passage pipe 78*b* connected with the water discharge pipe 9 and having a second impeller (77*b*, see FIG. 7) arranged therein.

Figure 6:
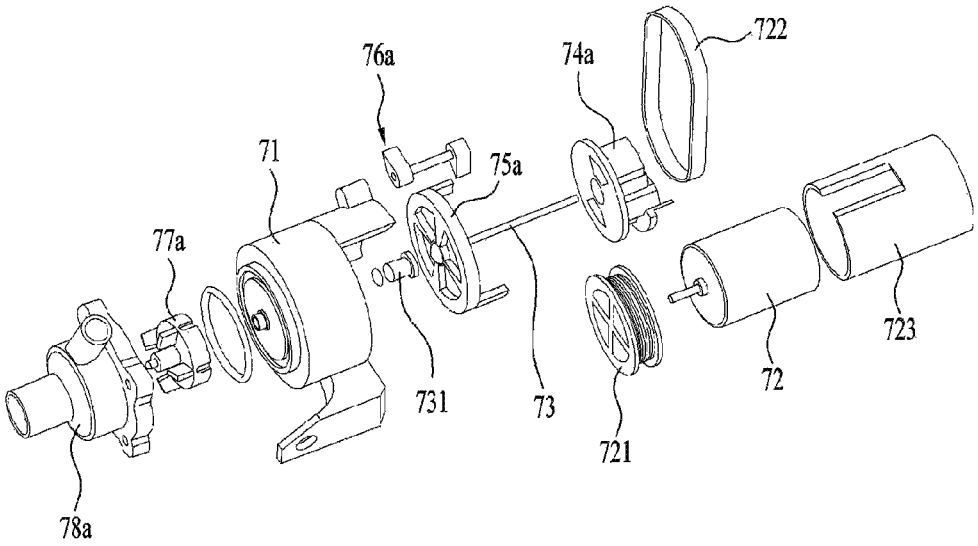
FIG. 6 is an exploded perspective view partially illustrating a pump assembly according to an embodiment.
Figure 7:
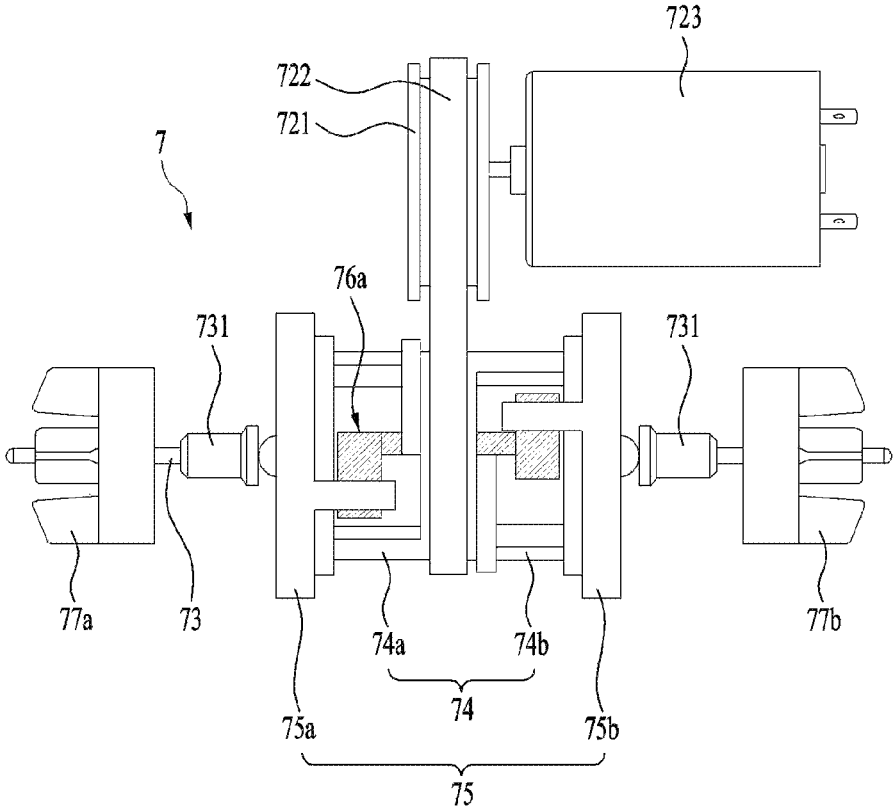
FIG. 7 is a diagram illustrating the inside of a pump assembly according to an embodiment.

The rotational force of the motor 72 may be transmitted to a drive pulley 721, and a belt 722 connected with the drive pulley 721 may transmit the rotational force to a wheel (74, see FIGS. 6 and 7).

The internal configuration of the pump housing 71 will be described, referring to FIGS. 6 and 7.

FIG. 6 is an exploded perspective view partially illustrating the pump assembly 7, connected to the water supply pipe 8. The structure of the water discharge pipe 9 is equal to that of the water supply pipe 8 and the internal structure of the pump assembly 7 connected to the water supply pipe 8 is symmetrical to that of the pump assembly 7 connected to the water discharge pipe 9.

The rotational force of the motor 72 may be transmitted to the wheel 74 via the drive pulley 721 and the belt 722. The wheel 74 may include a first wheel 74*a* provided closer to the water supply pipe 8 and a second wheel (74*b*, see FIG. 7) provided closer to the water discharge pipe 9. The first and second wheels 74*a* and 74*b* may be integrally formed with each other as one body or coupled to each other. In other words, both of the wheels 74*a* and 74*b* may be supplied with the rotational force of the belt 722.

The pump assembly 7 may further include a clutch 75 configured to be supplied with the rotational force of the wheels 74*a* and 74*b*. The clutch 75 may include a first clutch 75*a* provided adjacent to the first wheel 74*a*, and a second clutch 75*b* provided adjacent to the second wheel 74*b*.

The clutch 75 may receive the rotational force of the wheel 74 via a connecting part 76. An example of the operation configured to transmit the rotational force of the wheel 74 to the clutch 75 via the connecting part 76 will be described later.

Figure 8:
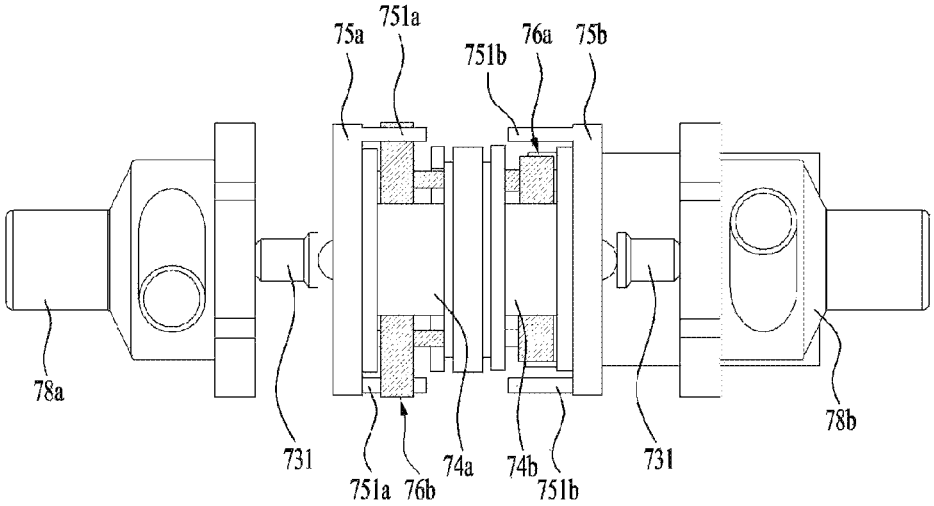
FIG. 8 is a bottom view of the pump assembly of FIG. 7.

The connecting part 76 may include a first connecting arm 76*a*, and a second connecting arm (76*b*, see FIG. 8). The rotational force of the wheel 74 may be transmitted to the clutch 75 by the mutual action between the first and second clutches 75*a* and 75*b*.

The first and second clutches 75*a* and 75*b* receiving the rotational force from the first and second connecting arms 76*a* and 76*b* may rotate the first and second impellers 77*a* and 77*b* each connected with a respective shaft 73.

Once the first clutch 75*a* is rotated, the shaft 73 provided in the center of the first clutch 75*a* in a state of being connected with the first clutch 75*a* may be rotated and the first impeller 77*a* connected with the shaft 73 may then be rotated. Also, once the second clutch 75*b* is rotated, the shaft 73 provided in the center of the second clutch 75*b* in a state of being connected with the second clutch 75*b* may be rotated and the second impeller 77*b* connected with the shaft 73 may then be rotated. The shaft 73 connected with the first clutch 75*a* may be separated from the shaft 73 connected with the second clutch 75*b* and they may be rotated independently.

A shaft bearing 731 may be provided on each of the shafts 73 and the shaft bearings 731 may be located in a pump housing 71 provided between the first and second impellers 77*a* and 77*b* and the first and second clutches 75*a* and 75*b*, respectively. That is, the shaft bearings 731 reduce the friction between the pump housing 71 and each shaft when each shaft 73 is rotated.

A motor bracket 723 may be provided in an outer area of the motor 72 to protect the motor 72.

FIG. 7 is a front view illustrating the assembly of the components inside of the pump assembly 7, with the pump housing 71 removed.

When the motor 72 is rotated in one direction, the wheels 74*a* and 74*b* may be rotated by the belt 722 having received the rotational force of the motor 72. The first wheel 74*a* and the second wheel 74*b* are fixedly coupled to each other to form one body such that they may be rotated in the same direction when being rotated.

Connecting part 76 may be rotatably coupled to the wheels 74*a* and 74*b*, as shown in FIG. 8. The first connecting arm 76*a* and the second connecting arm 76*b* may be spaced a preset distance apart from the center of the wheel 74. The first connecting arm 76*a* and the second connecting arm 76*b* may be symmetrically arranged with respect to the center of the wheel 74.

The two connecting arms 76*a* and 76*b* may be arranged over the first and second wheels 74*a* and 74*b*. In other words, halves of the connecting arms 76*a* and 76*b* may be provided in the first wheel 74*a* and the other halves may be provided in the second wheel 74*b*.

Each of the connecting arms 76*a* and 76*b* may be rotatable on its axis that is in parallel with the axis of the wheel 74. The rotation of the connecting arm 76*a* and 76*b* generates contact with the first clutch 75*a* or the second clutch 75*b*. Specifically, when the motor 72 is rotated in one direction, the first connecting arm 76*a* and the second connecting arm 76*b* may rotate the first clutch 75*a* by the contact with the first clutch 75*a*. When the motor 72 is rotated in the reverse direction, the first connecting arm 76*a* and the second connecting arm may rotate the second clutch 75*b* by the contact with the second clutch 75*b*.

Specifically, since the connecting arms 76*a* and 76*b* may contact with the clutches 75*a* and 75*b*, the rotation range is limited. The specific structure of the connecting arms 76*a* and 76*b* will be described later.

FIG. 8 is a bottom view of FIG. 7, illustrating both of the first and second connecting arms 76*a* and 76*b*. As mentioned above, each of the first and second connecting arms 76*a* and 76*b* may be spaced a preset distance apart from the center of the wheel 74, respectively. The distances between the connecting arms and the center of the wheel 74 are the same.

The first clutch 75*a* may include a first projection 751*a* and the second clutch 75*b* may include a second projection to transmit the rotational force to the connecting arms 76*a* and 76*b*. The first and second projections 751*a* and 751*b* may become the means for the contact of the clutches with the connecting arms 76*a* and 76*b*, respectively.

Each of the first and second projections 751*a* and 751*b* may include two projections. The first projections 751*a* may be projected towards the second clutch 75*b*, in parallel with the rotational direction of the first clutch 75*a*. The two first projections 751*a* may be symmetrically arranged with respect to the rotational center of the first clutch 75*a*. Accordingly, a virtual line between the two first projections 751*a* may pass the rotational center of the first clutch 75*a*. The first projections 751*a* may be provided in an edge area of the first clutch 75*a*.

The second projections 751*b* may be projected towards the first clutch 75*a*, in parallel with the rotational direction of the second clutch 75*b*. The two second projections 751*b* may be symmetrically arranged with respect to the rotational center of the second clutch 75*b*. Accordingly, a virtual line between the two second projections 751*b* may pass the rotational center of the second clutch 75*b*. The second projections 751*b* may be provided in an edge area of the second clutch 75*b*.

FIG. 8 illustrates a state where a liquid flows in the water supply pipe 8. The rotation of the motor in one direction may rotate the wheels 74*a* and 74*b* in one direction. The first connecting arm 76*a* and the second connecting arm 76*b* provided on the wheels 74*a* and 74*b* may contact with the first projections 751*a* provided on the first clutch 75*a*.

The first connecting arm 76*a* and the second connecting arm 76*b* may rotate the first clutch 75*a*, while contacting with the first projections, respectively. The rotation of the first clutch 75*a* may rotate the shaft 73 provided in the first clutch 75*a*, and the rotation of the shaft 73 may rotate the first impeller 77*a* provided in the first passage pipe 78*a*. The rotation of the first impeller 77*a* may facilitate the flow of water through the passage in the water supply pipe 8.

At this time, as the first and second connecting arms 76*a* and 76*b* are not in contact with the second projections 751*b*, the second clutch 75*b* will not be rotated. As the second impeller 77*b* is not rotated, no liquid will flow in the water discharge pipe 9.

If a liquid is intended to flow in the water discharge pipe 9, the rotational direction is changed into the reverse direction. If the rotational direction of the motor 72 is changed, the first and second connecting arms 76*a* and 76*b* will collide with the first projections 751*a*, respectively, and then the resultant rotation of the first and second connecting arms 76*a* and 76*b* will result in the connecting arms coming only into contact with the second projections 751*b*, respectively.

When each of the first and second connecting arms 76*a* and 76*b* contacts with the second projections 751*b*, respectively, the second clutch 75*b* may be rotated. The rotation of the second clutch 75*b* may rotate the shaft 73 provided in the second clutch 75*b* and the rotation of the shaft 73 may rotate the second impeller 77*b* provided in the second passage pipe 78*b*. The rotation of the second impeller 77*b* may facilitate the flow passage in the water discharge pipe 9.

At this time, as the first and second connecting arms 76*a* and 76*b* are not in contact with the first projections 751*a*, the first clutch 75*a* will not be rotated. As the first impeller 77*a* is not rotated, no liquid will flow in the water supply pipe 8.

Figure 9:
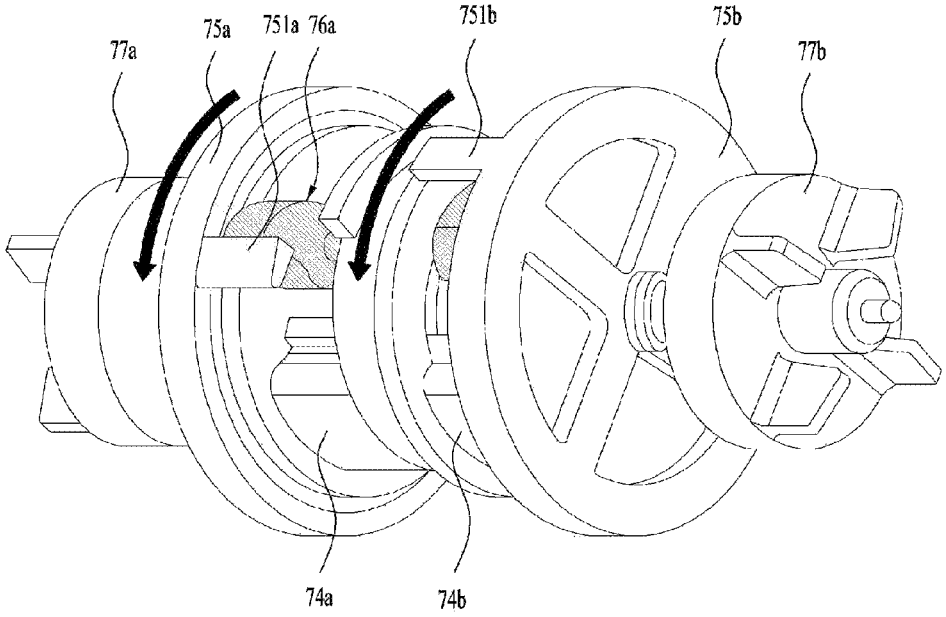
FIG. 9 is a perspective view of a pump assembly showing one example of an operation when a motor is rotated in one direction.
Figure 10:
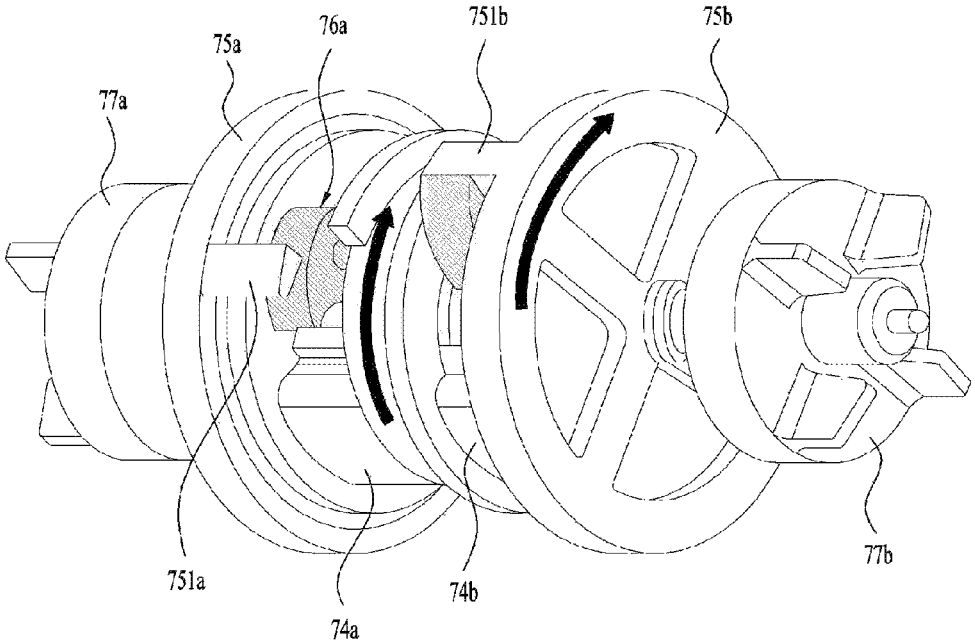
FIG. 10 is a perspective view of the pump assembly of FIG. 9, showing one example of an operation when a motor is rotated in the reverse direction.
Figure 11:
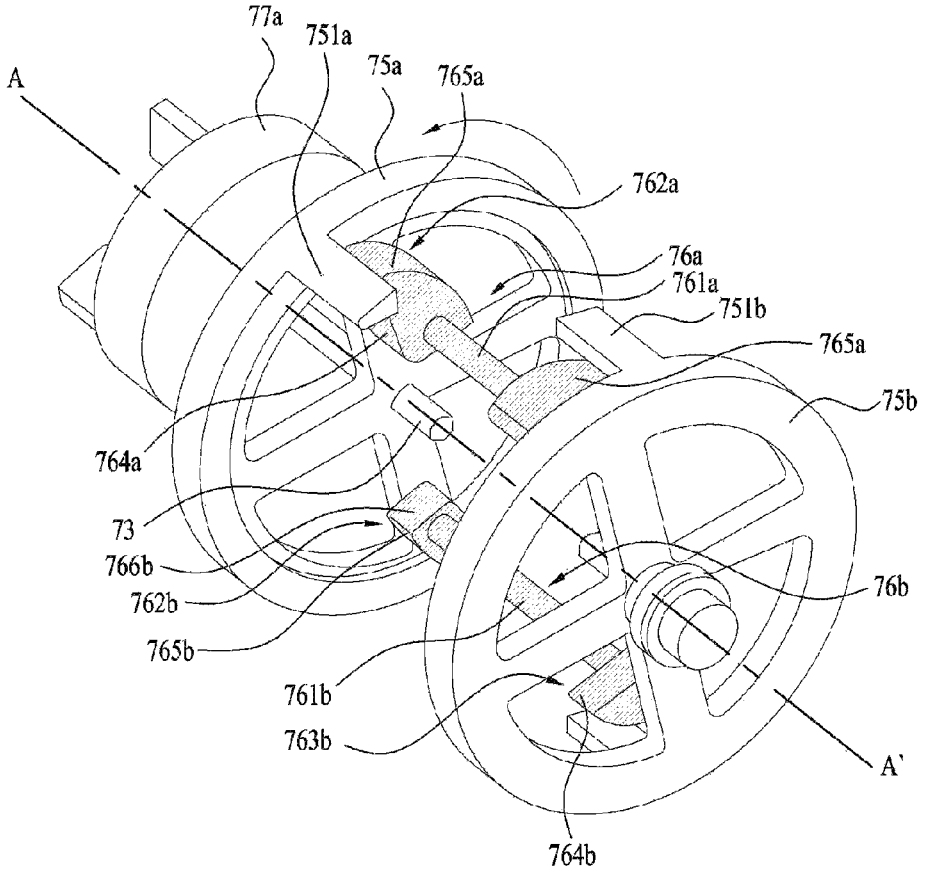
FIG. 11 is a perspective view of a pump assembly in accordance with an embodiment illustrating some components during one example of an operation when the motor is rotated in one direction.

Referring to FIGS. 9 through 11. The specific structure of the connecting part 76 and the mutual action between the connecting arms 76*a* and 76*b* and the projections 751*a* and 751*b* will be described.

FIG. 9 is a perspective view of FIG. 8, viewed from a different angle, and FIG. 10 is a perspective view illustrating a state where only the rotational direction is changed. FIG. 11 is a diagram showing the mutual action between the connecting arms 76*a* and 76*b* and the projections 751*a* and 751*b*.

Referring to FIG. 11, the specific structure of the connecting arms will be described first. The connecting arms 76 may include the first connecting arm 76*a* and the second connecting arm 76*b*, and the first and second connecting arms 76*a* and 76*b* may have the same shape. Here, the first connecting arm 76*a* and the second connecting arm 76*b* may be arranged in symmetrical positions with respect to the rotational axis of the wheel 74.

The first connecting arm 76*a* may include a connecting bar 761*a* rotatably coupled to the wheel, and parallel with each shaft 73. A first hand 762*a* may be provided at one end of the connecting bar 761*a* and configured to mutually actuate with the first projection 751*a*, and a second hand 763*a* may be provided at the other end of the connecting bar 761*a* and configured to mutually actuate with the second projection 751*b*.

The second connecting arm 76 may include a connecting bar 761*b* rotatably coupled to the wheel 74, and parallel with each shaft 73. A first hand 762*b* may be provided at one end of the connecting bar 761*b* and configured to mutually actuate with the first projection 751*a*, and a second-hand 763*b* may be provided at the other end of the connecting bar 761*b* and configured to mutually actuate with the second projection 751*b*.

The first hands 762*a* and 762*b* and the second hands 763*a* and 763*b* may have a predetermined thickness in a direction towards the shaft 73. The thickness of the first hands 762*a* and 762*b* and the second hands 763*a* and 763*b* may have one or more planar surfaces 764*a* and 764*b* and one or more curved surfaces 765*a* and 765*b*. The planar surfaces 764*a* and 764*b* and the curved surfaces 765*a* and 765*b* are shown in FIGS. 12 through 14.

Figure 12:
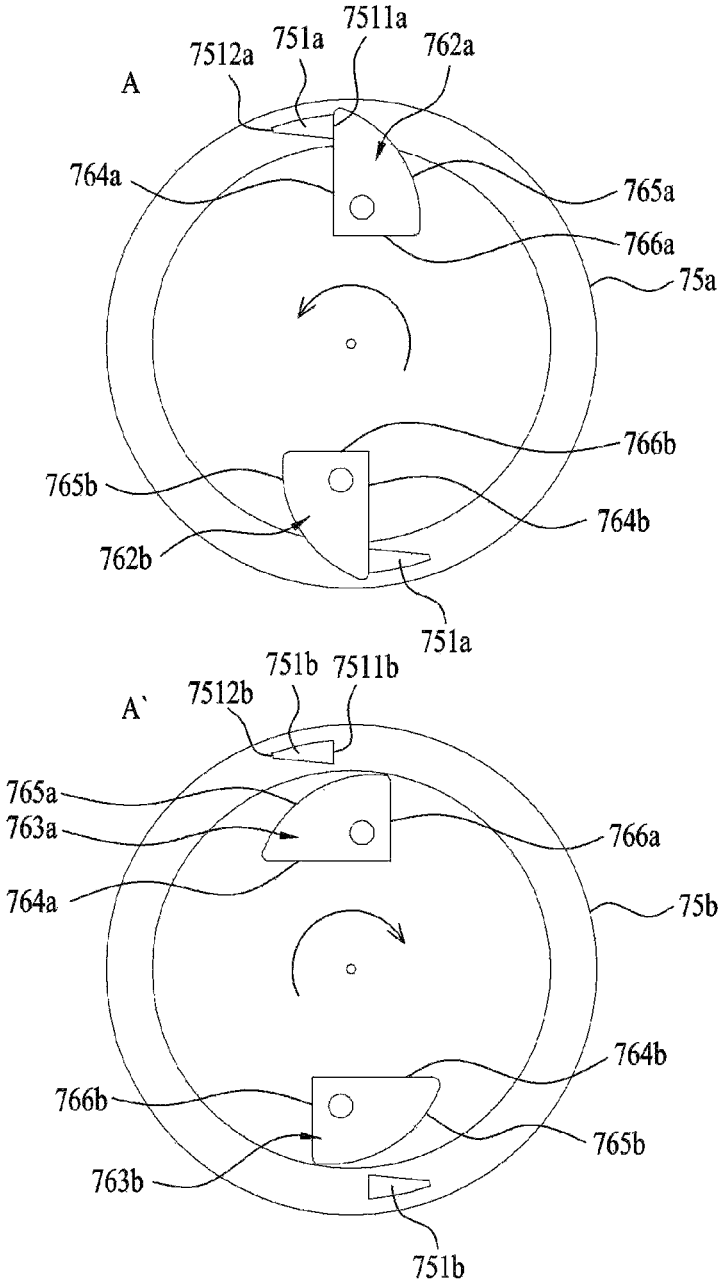
FIG. 12 is a diagram illustrating an example of an operation when a pump assembly according to an embodiment is rotated in a clockwise direction and in a counterclockwise direction.
Figure 13:
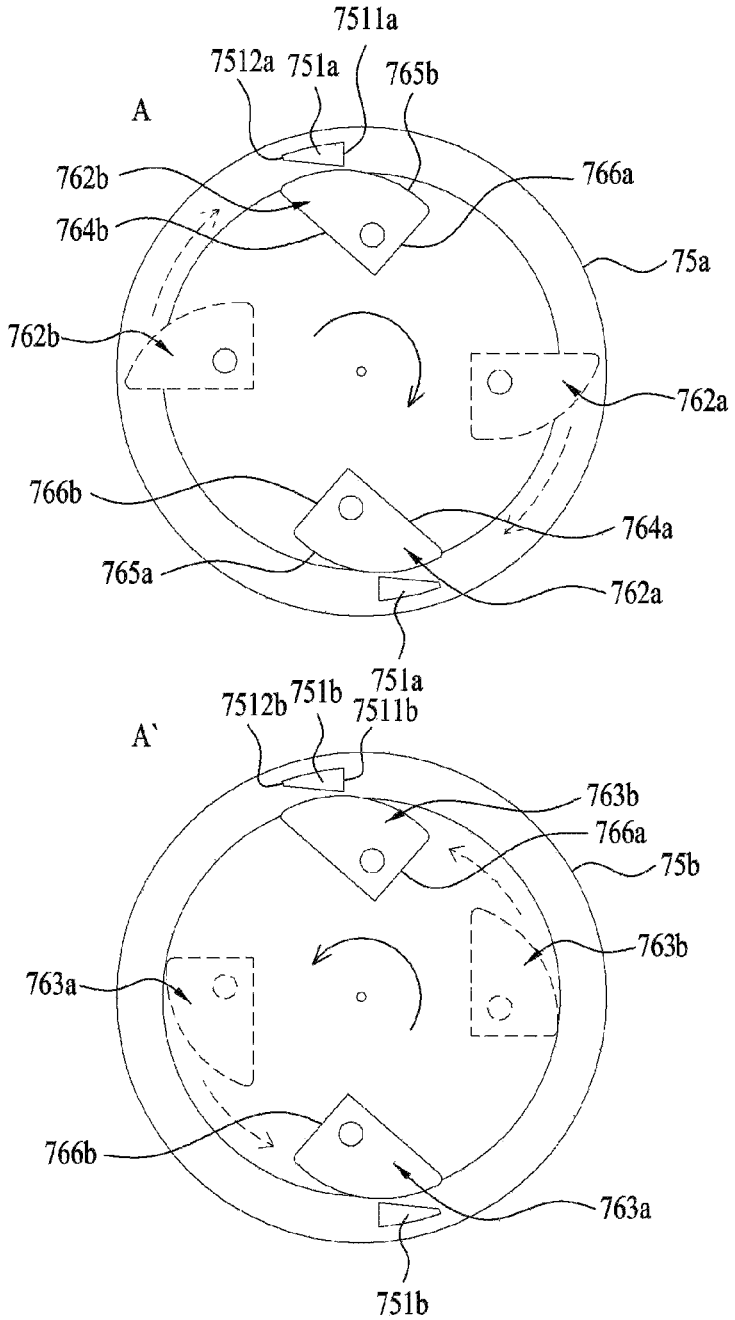
FIG. 13 is a diagram illustrating an example of an operation when the pump assembly shown in FIG. 12 is rotated in clockwise and counterclockwise directions after a preset time period following the positions shown in FIG. 12.
Figure 14:
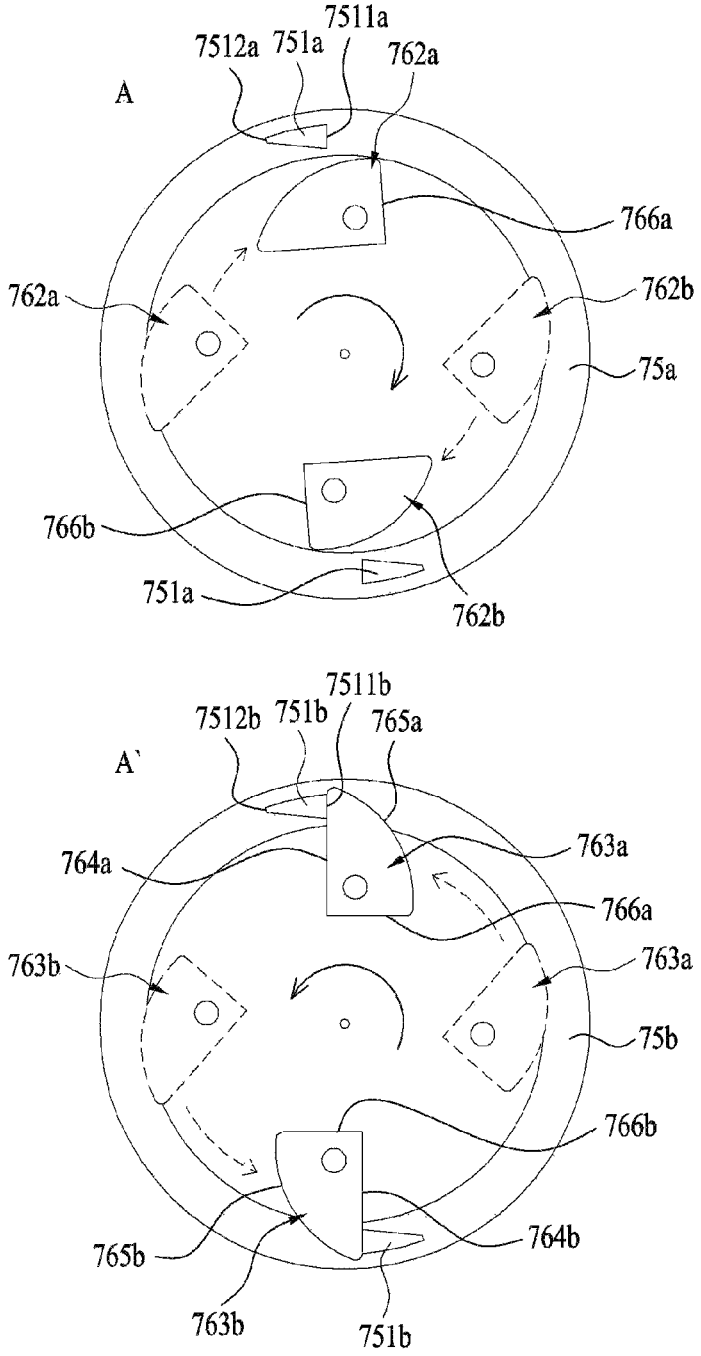
FIG. 14 is a diagram illustrating an example of an operation when the pump assembly shown in FIG. 12

In one embodiment shown in FIGS. 12 through 14, the first hands 762*a* and 762*b* may include bottom surfaces 766*a* and 766*b*, planar surfaces 764*a* and 764*b* extended from one of the ends of each of the bottom surfaces 766*a* and 766*b*, and curved surfaces 765*a* and 765*b* extended from the other of the ends of each of the bottom surfaces and connected with the ends of the planar surfaces 764*a* and 764*b*.

The connecting bars 761*a* and 761*b* may be provided closer to the shaft 73 than the first and second projections 751*a* and 751*b*. Accordingly, when the bottom surface 766*a* of the first hand 762*a* is directed towards the shaft 73, the end of the planar surface 764*a* may have a length long enough to contact with the first projection 751*a*. When a bottom surface 766*a* of the second hand 763*a* is directed towards the shaft 73, one end of the planar surface 764*a* may have a length long enough to contact with the second projection 751*b*.

Similarly, when the bottom surface 766*b* of the first hand 762*b* is directed towards the shaft 73, one end of the planar surface 764*b* may have a length long enough to contact with the first projection 751*a*. When the bottom surface 766*b* of the second hand 763*b* is directed towards the shaft 73, one end of the planar surface 764*b* may have a length long enough to contact with the second projection 751*b*.

The width of the bottom surface 766*a* or 766*b* may be shorter than a distance between the connecting bar 761*a* or 761*b* and the first projection 751*a* or the second projection 751*b*. At times other than when the first hand 762*a* or 762*b* contacts with the first projection 751*a*, one end of the bottom surface 766*a* or 766*b* of the first hand is located farther from the shaft 73 than the other end of the bottom surface. At times other than when the second hand 763*a* or 763*b* contacts with the second projection 751*b*, one end of the bottom surface 766*a* or 766*b* of the second hand is located farther from the shaft 73 than the other end of the bottom surface.

When the length of the bottom surface is longer than the distance between the connecting bar 761*a* or 761*b* and the first projection 751*a* or the second projection 751*b*, the bottom surface may contact with the first projection 751*a* or the second projection 751*b*, accordingly, it is preferred that the width of the bottom surface is shorter than the distance between the first projection 751*a* or the second projection 751*b* and the connecting bar 761*a* or 761*b*.

The end of the bottom surface 766*a* or 766*b* may be positioned between the connecting bar 761*a* or 761*b* and the first projection 751*a* or the second projection 751*b*, when it is the farthest from the shaft 73.

The first hand and the second hand according to one embodiment of the present disclosure may be formed in a similar shape to a shark's fin and have a predetermined thickness. However, the shape is not limited thereto and any shape may be applicable with the first and second hands having one or more planar surfaces and one or more curved surfaces.

The first hand 762*a* and the second hand 763*a* that are provided on the first connecting arm 76*a* may be perpendicular with a virtual line that coincides with the bottom surfaces 766*a* and also perpendicular with a virtual extended line that coincides with the planar surfaces 764*a*. Accordingly, when the first hand 762*a* contacts with the first projection 751*a*, the second hand 763*a* may be perpendicular with the first hand 762*a*. As the bottom surface 766*a* is positioned between the shaft 73 and the second projection 751*b*, the second hand 763*a* may not contact with the second projection 751*b*. The end of the bottom surface 766*a* (that is positioned farthest from the shaft 73) may not contact with the second projection 751*b*. In contrast, when the second projection 751*b* contacts with the second hand 763*a*, the first projection 751*a* and the first hand 762*a* may not contact with each other.

Like the first connecting arm 76*a*, virtual extended surfaces coinciding with the bottom surfaces 766*b* may be perpendicular with each other in the first hand 762*b* and the second hand 763*b* provided on the second connecting arm 76*b*, respectively. Virtual extended surfaces coinciding with the planar surfaces 764*b* may be perpendicular with each other. Accordingly, when the first hand 762*b* contacts with the first projection 751*a*, the second hand 763*b* may be perpendicular with the first hand 762*b*. As the bottom surface 766*b* is positioned between the shaft 73 and the second projection 751*b*, the second hand 763*b* may not contact with the second projection 751*b*. In other words, the end of the bottom surface 766*b* (that is positioned farthest from the shaft 73) may not contact with the second projection 751*b*. In contrast, when the second projection 751*b* contacts with the second hand 763*b*, the first projection 751*a* and the first hand 762*b* may not contact with each other.

FIG. 11 illustrates AA' axis. When viewing A from A' in a state where the bottom surface 766*a* is directed towards the shaft 73, the planar surface 764*a* or 764*b* of the first hand 762*a* or 762*b* may be positioned in a counter-clockwise direction with respect to AA' axis, compared with the curved surfaces 765*a* or 765*b*.

When viewing A from A' in a state where the bottom surface 766*b* is directed towards the shaft 73, the planar surface 764*a* or 764*b* of the second hand 763*a* or 763*b* may be positioned in a counter-clockwise direction with respect to AA' axis, compared with the curved surfaces 765*a* or 765*b*.

When the wheel 74 is rotated in the counter-clockwise direction with respect to the view of A from A' along AA' axis as shown in FIG. 11, the planar surface 764*a* of the first hand 762*a* and the planar surface 764*b* of the first hand 762*b* may contact with the first projections 751*a*, respectively.

When the wheel 74 is rotated in the clockwise direction in the state of FIG. 11, the planar surface 764*a* of the first hand 762*a* may be released from the contact with the first projection 751*a* and the curved surface 765*a* of the first hand 762*a* may be collided with the first projection 751*a*. The connecting bar 761*a* may be rotated by the collision. As the first hand 762*a* and the second hand 763*a* are perpendicular with each other, the planar surface of the second hand 763*a* may contact with the second projection 751*b*. In other words, the second clutch 75*b* may be rotated. The first hand 762*b* of the second connecting arm 76*b* may perform the same operation with the first hand 762*a* and the second hand 763*b* may perform the same operation with the second hand 763*a*. In brief, the second hand 763*a* or 763*b* may contact with the second projections 751*b*, respectively, and the second clutch 75*b* may be rotated by the contact.

FIGS. 9 and 10 are diagrams illustrating the wheels 74*a* and 74*b*. FIG. 9 illustrates a state where the wheel is rotated in the counter-clockwise direction and FIG. 10 illustrates a state where the wheel is rotated in the clockwise direction.

FIG. 9 shows that the planar surface 764*a* of the first hand 762*a* rotates the first clutch 75*a* while contacting with the first projection 751*a*. In FIG. 10 having the reversed rotational direction, the curved surface 765*a* of the first hand 762*a* rotates the connecting bar 761*a* while colliding with the first projection 751*a*. Accordingly, the planar surface 764*a* of the second hand 763*a* may rotate the second clutch 75*b* while contacting with the second projection 751*b*.

FIGS. 12 through 14 illustrate the mutual action between the connecting arm 76 and the projections 751*a* and 751*b* as time passes. From a view from A' towards A with respect to AA' axis of FIG. 11, the mutual action between the first clutch 75*a* and the first hand 762 or 762*b* is shown in an upper area. From a view of A towards A', the mutual action between the second clutch 75*b* and the second hand 763*a* or 763*b* is shown in a lower area. In other words, the device in A along AA' axis of FIG. 11 is shown in the upper area and the device in A' along AA' axis is shown in the lower area.

Referring to FIG. 12, the specific structure of the first and second projections 751*a* and 751*b* will be described in detail.

The first projection 751*a* includes a contact surface 7511*a* corresponding to a surface contacting with the planar surface 764*a* or 764*b* of the first hand 762*a* or 762*b*, and a collision surface 7512*a* corresponding to a surface colliding with the curved surface 765*a* or 765*b* of the first hand 762*a* or 762*b*.

The contact surface 7511*a* has a larger area than the collision surface 7512*a*. This allows the rotational force to be transmitted to the first clutch 75*a* from the planar surface 764*a* or 764*b* of the first hand 762*a* or 762*b* in a stable manner.

In contrast, the collision surface 7512*a* may have a small area. This results in the rotation of the connecting bar 761*a* by applying a strong shock to the curved surface 765*a* or 765*b* of the first hand 762*a* or 762*b*. The curved surface 765*a* or 765*b* colliding with the collision surface 7512*a* is curved such that friction with the collision surface 7512*a* may occur, which is shown in FIG. 13 specifically.

The first projection 751*a* includes a contact surface 7511*b* corresponding to a surface contacting with the planar surface 764*a* or 764*b* of the second hand 763*a* or 763*b*; and a collision surface 7512*b* corresponding to a surface colliding with the curved surface 765*a* or 765*b* of the second hand 763*a* or 763*b*.

The contact surface 7511*b* has a larger area than the collision surface 7512*b*. This allows the rotational force to be transmitted to the second clutch 75*b* from the planar surface 764*a* or 764 of the second hand 763*a* or 763*b* in a stable manner.

In contrast, the collision surface 7512*b* may have a small area. This results in rotation of the connecting bar 761*b* by applying a strong shock to the curved surface 765*a* or 765*b* of the second hand 763*a* or 763*b*. The curved surface 765*a* or 765*b* colliding with the collision surface 7512*b* is curved such that friction with the collision surface 7512*b* may occur, which is shown in FIG. 13 specifically.

FIG. 12 illustrates that the wheel 74 is rotated in the counter-clockwise direction, viewed from A' towards A with respect to AA' axis shown in FIGS. 9 and 11. An upper drawing and a lower drawing show that the rotational directions are reversed. That is a difference whether the direction is from A' towards A or from A towards A' but the wheel is substantially rotated in the same direction.

Referring to the drawing towards A, the first hand 762*a* or 762*b* contacts with the contact surface 7511*a* of the first projection 751*a* and it is shown that the rotational force of the wheel 74 is transmitted to the first clutch 75*a* via the first hand 762*a* or 762*b* and the first projection 751*a*.

Referring to the drawing towards A', the second hand 763*a* or 763*b* may not contact with the second projection 751*b*. The first hand 762*a* and the second hand 763*a* are perpendicular with each other. Accordingly, only when the wheel 74 is continuously rotated in the counter-clockwise direction, viewed from A' towards A shown in FIG. 12, the rotational force of the wheel 74 may be transmitted only to the first clutch 75*a*.

Compared with FIG. 12, FIG. 13 shows a state where the rotational direction of the wheel 74 is changed into the clockwise direction with respect to the AA' direction from A' towards A.

The state of A area (that is, the upper drawing) of FIG. 12 where the first hand 762*a* or 762*b* is rotated 90 degrees with respect to the shaft 73 in the clockwise direction is shown in FIG. 13 in a dotted line. The state where the wheel is rotated 90 degrees again is shown in a solid line.

Right after the rotational direction of the wheel 74 is changed, the connecting bar 761*a* will not be rotated until the curved surface 765*a* or 765*b* of the first hand is collided with the collision surface 7512*a*. However, when the planar surface 764*a* or 764*b* of the first hand is released from the contact with the contact surface 7511*a* provided in the first projection 751*a* and rotated 180 degrees with respect to the shaft 73, the collision surface 7512*a* provided in the first projection 751*a* and the curved surface 765*a* or 765*b* are collided with each other.

As shown in the upper drawing of FIG. 13, the connecting bar 761*a* may be rotated by the collision and the first hand 762*a* or 762*b* may be rotated a preset angle. The second hand 763*a* connected with the first hand 762*a* and the second hand 763*b* connected with the first hand 762*b* may be rotated as much as the first hand is rotated a preset angle.

The second hand 763*a* or 763*b* shown in the A' area of FIG. 13 (the lower drawing) may keep a non-contact state with the second projection 751*b* continuously. The state where the second hand is rotated 90 degrees with respect to the shaft 73 in the clockwise direction is shown in a dotted line of FIG. 13. The state where the wheel is rotated 90 degrees again is shown in a solid line. The reason why the second hand shown in the solid line is rotated a preset angle is that the first hand is collided with the collision surface 7512*a* of the first projection.

The rotation of the first hand may rotate the connecting bars 761*a* and 761*b* and then the second hand. Accordingly, when the second hand is rotated 180 degrees with respect to the shaft 73, the second hand is in a state shown in a lower drawing of FIG. 13.

FIG. 14 illustrates a state where both of the first and second hands are rotated on the shaft 73 180 degrees, compared with FIG. 13. A dotted line of FIG. 14 shows a state where the hands are rotated 90 degrees from the state shown in the dotted line of FIG. 13 and a solid line shows a state where they are rotated 80 degrees from the state shown in the solid line of FIG. 13.

Referring to A area of FIG. 14 (an upper drawing of FIG. 14), the first hand 762*a* or 762*b* rotated 90 degrees from the solid line of FIG. 13 is shown in the same shape with the solid line of FIG. 13. The first hand keeps the same shape before being rotated 180 degrees after colliding with the collision surface 7512*a*. That is equal to the second hand 763*a* or 763*b* shown in A' area (a lower drawing).

When the wheel 74 is rotated 90 degrees more as shown in A area of FIG. 14 in a solid line from a dotted line, the connecting bar 761*a* may be rotated a preset angle more. In other words, the final position of the first hand in A area drawing is equal to the initial position of the second hand shown in FIG. 12.

The reason for the rotation shown in A area of FIG. 14 will be described referring to A' area of FIG. 14.

When the second hand is rotated 90 degrees from the state shown in a solid line corresponding to the final position in A' area of FIG. 13, the position is changed into a position shown in a dotted line of A' area of FIG. 14. In this instance, when it is rotated 90 degrees more, the position is changed into a position shown in a solid line of A' area of FIG. 14. At this time, a point at which the planar surface 764*a* or 764*b* meets the curved surface 765*a* or 765*b* may be positioned in an area that allows the contact with the contact surface 7511*b* of the second projection 751*b*. Specifically, in FIG. 13, the rotation of the connecting bar 761*a* or 761*b* may rotate the second hand to a position that facilitates contact with the contact surface 7511*a* of the second projection.

When the second hand is continuously rotated, the planar surface 764*a* or 764*b* of the second hand may completely contact the contact surface 7511*b* of the second projection. In other words, the second hand shown in A' area of FIG. 14 is located at the same position as the position of the first hand shown in FIG. 12.

In brief, the change of the rotational direction may facilitate the contact between the planar surface 764*a* or 764*b* of the second hand and the contact surface 7511*b* of the second projection. The rotational force of the wheel 74 may be transmitted to the second clutch 75*b* via the second hand. In contrast, during rotation of the wheel 74 in this direction, the first hand does not contact the first projection and the first clutch 75*a* is not rotated.

When the rotational direction of the wheel 74 is changed again from the final state of FIG. 14, the first and second hands are rotated in the same manner as with the operation described in reference to FIGS. 12 through 14. Accordingly, the first hand may rotate the first projection 751*a* and the second hand does not contact the second projection 751*b*.

Consequently, the liquid inside the water supply pipe 8 or the water discharge pipe 9 may flow in only one of the water supply pipe 8 or the water discharge pipe 9 depending on the rotational direction of the motor 72. The independent cycle of each passage is performed by changing the rotational direction of the motor 72. Accordingly, when compared with a conventional clothes treating apparatus using two pumps (including two motors), an energy savings may be realized. The use of only one motor 72 is advantageous in improving the space utilization of the clothes treating apparatus, and in reducing material costs.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A clothes treating apparatus, comprising:

a water supply pipe configured to supply water to an inside of the clothes treating apparatus;

a water discharge pipe configured to discharge the water from the clothes treating apparatus; and a pump assembly configured to generate flow of the water inside the water supply pipe or inside the water discharge pipe, using rotation of a motor, and wherein the pump assembly comprises:

a wheel that is configured to be rotated by the motor;

a pair of clutches provided on both sides of the wheel, respectively, wherein each of the pair of clutches is configured to rotate independently from each other with respect to the wheel;

a pair of shafts fixed to the pair of the clutches, respectively;

a pair of impellers connected with each of the pair of shafts and configured to rotate with rotation of a respective one of the pair of clutches; and a connecting part mounted rotatably with respect to the wheel and configured to transmit a rotational force of the wheel to a respective one of the pair of clutches based on the rotational direction of the motor, wherein the pair of clutches comprises:

a first clutch provided on one side of the wheel;

a second clutch provided on the other side of the wheel; and a pair of projections respectively projected from the first clutch and the second clutch toward the wheel and configured to rotate the connecting part with respect to the wheel, and wherein the connecting part comprises a first connecting arm and a second connecting arm that are spaced a preset distance apart from a center of rotation of the wheel and symmetrically arranged with respect to the center of rotation of the wheel, and wherein each of the connecting arms comprises:

a connecting bar rotatably coupled to the wheel and provided in parallel to the pair of shafts;

a first hand provided on one end of the connecting bar; and a second hand provided on the other end of the connecting bar, wherein the first hand is configured to contact the first clutch to rotate the first clutch, and the second hand is configured to contact the second clutch to rotate the second clutch, and wherein the flow of the water is generated only in the water supply pipe or only in the water discharge pipe depending on a rotational direction of the motor.

2. The clothes treating apparatus of claim 1, wherein the pump assembly comprises, each of the pair of clutches having a rotational center that is coaxial with the rotational center of the wheel, and wherein the pair of shafts are fixed to the rotational centers of the pair of clutches, respectively.

3. The clothes treating apparatus of claim 1, wherein:

the first hand contacts the first clutch when the motor is rotated in a first direction, the second hand does not contact the second clutch when the motor is rotated in the first direction, the first hand does not contact the first clutch when the motor is rotated in a second direction opposite to the first direction, and the second hand contacts the second clutch when the motor is rotated in the second direction.

4. The clothes treating apparatus of claim 1, wherein the pair of projections comprises a first projection projected towards the wheel and configured to contact the first hand, and a second projection projected towards the wheel and configured to contact the second hand.

5. The clothes treating apparatus of claim 4 wherein the first clutch comprises two first projections symmetrically arranged with respect to a rotational center of the first clutch, and the second clutch comprises two second projections symmetrically arranged with respect to a rotational center of the second clutch.

6. The clothes treating apparatus of claim 4, wherein each of the first and second projections comprises:

a contact surface that is configured to come into contact with the first hand or the second hand; and a collision surface that is configured to collide with the first hand or the second hand.

7. The clothes treating apparatus of claim 6 wherein the contact surface has a larger area than the collision surface.

8. The clothes treating apparatus of claim 6, wherein the first hand and the second hand of each of the connecting arms are perpendicular with each other.

9. The clothes treating apparatus of claim 8, wherein each of the first and second hands comprises a planar surface provided in a predetermined first area and a curved surface provided in a second area.

10. The clothes treating apparatus of claim 9, wherein when the wheel is rotated in one direction, the planar surfaces of the first hands contact the contact surfaces of the first projections, respectively, and the second hands do not contact the second projections.

11. The clothes treating apparatus of claim 10, wherein when the wheel is rotated in a reverse direction opposite to the one direction, the planar surfaces of the second hands contact the contact surfaces of the second projections and the first hands do not contact the first projections.

12. The clothes treating apparatus of claim 10, wherein when the wheel is rotated in a reverse direction opposite to the one direction after being rotated in the one direction for a preset time period, the curved surfaces of the first hands collide with the collision surfaces of the first projections and the connecting bars are then rotated.

13. The clothes treating apparatus of claim 12, wherein the rotation of the connecting bars results in contact between the planar surfaces of the second hands and the contact surfaces of the second projections, and the first hands do not contact the first projections.

14. The clothes treating apparatus of claim 1, further comprising:

a steam supply device configured to supply steam into a clothes-accommodation unit of the clothes treating apparatus; and a heat pump configured to generate hot air for supply to the clothes-accommodation unit.

15. The clothes treating apparatus of claim 1, wherein the pair of impellers comprises:

a first impeller in fluid communication with the water supply pipe; and a second impeller in fluid communication with the water discharge pipe, wherein the first impeller and the second impeller are not rotated at the same time.

* * * * *